United States Patent [19]

Toriyama

[11] Patent Number: 4,784,558

[45] Date of Patent: Nov. 15, 1988

[54] APPARATUS FOR INVERTING AND STACKING FOLDED BOX BLANKS MADE OF SHEET MATERIAL

[75] Inventor: Daigoro Toriyama, Chiba, Japan

[73] Assignee: Tanabe Machinery Co., Ltd., Tokyo, Japan

[21] Appl. No.: 100,343

[22] Filed: Sep. 23, 1987

[30] Foreign Application Priority Data

Jul. 30, 1987 [JP] Japan ..... 62-188958

[51] Int. Cl.[4] ..... B65G 57/08

[52] U.S. Cl. ..... 414/56; 198/419; 271/3.1; 271/6; 414/31; 414/46; 414/52; 414/783

[58] Field of Search ..... 198/374, 409, 419, 422; 271/3.1, 6, 7, 113; 414/31, 33, 46, 52, 54, 56, 783

[56] References Cited

U.S. PATENT DOCUMENTS

| | | | |
|---|---|---|---|
| 2,940,613 | 6/1960 | Prentice et al. | 414/783 |
| 3,488,693 | 1/1970 | Brinkmeier | 414/31 |
| 3,508,640 | 4/1970 | DeGood et al. | 198/374 |
| 3,995,540 | 12/1976 | Huiskes | 414/46 |
| 4,134,502 | 1/1979 | Seragnoli | 414/46 |
| 4,155,133 | 5/1979 | Timson | 198/374 X |
| 4,307,800 | 12/1981 | Joa | 198/374 |
| 4,474,521 | 10/1984 | Jaton | 198/374 X |

FOREIGN PATENT DOCUMENTS

| | | | |
|---|---|---|---|
| 2437475 | 5/1975 | Fed. Rep. of Germany | 414/52 |
| 61-111230 | 5/1986 | Japan . | |
| 1512367 | 6/1978 | United Kingdom | 271/3.1 |

*Primary Examiner*—Robert J. Spar
*Assistant Examiner*—Janice Krizek
*Attorney, Agent, or Firm*—Wenderoth, Lind & Ponack

[57] ABSTRACT

An apparatus for stacking a plurality of folded box blanks such that alternating groups of a predetermined number of folded blanks are superimposed in opposite orientations. The apparatus includes a lower rail device having a stacking position, a second rail device above the first rail device and terminating at a position above an intermediate portion of the lower rail device, an inverting and transferring device for inverting alternating stacks of a predetermined number of folded blanks stacks at the stacking position onto the second rail device, a stopper device for allowing alternating stacks to move along the lower rail device, and a conveying device for conveying both the stacks on the lower rail device and the upper rail device simultaneously so that each stack on the upper rail device falls onto a stack on the lower rail device at the end of the upper rail device, whereby the desired combined stack is formed on the lower rail device.

35 Claims, 4 Drawing Sheets

APPARATUS FOR INVERTING AND STACKING FOLDED BOX BLANKS MADE OF SHEET MATERIAL

BACKGROUND OF THE INVENTION

1. Field of the Invention

The present invention broadly relates to handling of folded box blanks glued only at bottom portions thereof and, hence, having different thicknesses at opposite ends thereof. More particularly, the invention is concerned with an apparatus for stacking such folded box blanks in such a manner that alternating groups of a predetermined number of blanks are inverted through 180°, i.e., in such a manner that the head portions of the blanks of one group are placed directly over the bottom portions of the blanks of an underlying group of blanks.

2. Description of the Prior Art

In the field of box production wherein the boxes are made of, for example, cardboard sheet, it is common practice to fold a box blank which is glued only at the bottom portion thereof and to stack a plurality of folded box blanks in layers before they are delivered. As is well known, such a blank can easily be set up in the form of a box which is ready for convenient use.

A problem is encountered in this process in that each folded blank has a difference in thickness between the bottom portion which is glued together and the top portion which is not glued so that the difference in the thickness is multiplied when a plurality of such blanks are stacked in the same orientation with the result that a large difference in height is created between opposite ends of the stack or the stack is rendered unstable. In order to eliminate this problem, it is necessary to periodically change the orientation of the blanks by inverting the blanks through a rotation of 180° for a predetermined number of blanks, e.g., blanks in an upper half of a stack have an orientation which is opposite to that of the blanks in the lower half of the stack.

In order to satisfy such a demand, an apparatus has been proposed which is capable of effecting such inverting of the folded box blanks. This apparatus can conveniently be incorporated in a system for making boxes in such a manner that the process includes a step of periodically changing the orientation of the stacked blanks.

In general, a process for making boxes from a sheet material such as cardboard includes a step of conveying blanks by means of a conveyor. It has therefore been proposed to incorporate a mechanism which is designed to change the orientation of the blanks such that alternating groups of blanks which are being successively conveyed by a conveyor are oriented in opposite directions. Unfortunately, however, the known mechanisms for accomplishing this result require an excessive time for inverting the blanks and yet fail to smoothly invert the blanks.

SUMMARY OF THE INVENTION

Accordingly, an object of the present invention is to provide an apparatus which is capable of stacking folded box blanks while inverting them suitably such that alternating groups of a predetermined number of blanks are oriented in opposite directions.

To this end, according to a first aspect of the present invention, there is provided an apparatus for inverting and stacking a plurality of folded box blanks, each of which has a different thickness at its top and tail end portions, comprising: supplying means for supplying the blanks while counting the number of the blanks; first rail means extending in a predetermined direction of conveyance and adapted for stacking and carrying the blanks supplied by the supplying means; stopper means for stopping and retaining the blanks supplied by the supplying means at a predetermined stacking position on the first rail means; second rail means extending in the direction of conveyance and disposed at a level above the level of the first rail means, the second rail means having an upstream end disposed downstream of an upstream end of the first rail means as viewed in the direction of conveyance, the second rail means terminating at a position above an intermediate portion of the first rail means; transferring means for inverting the stack of blanks on the first rail means onto the second rail means when the number counted by the supplying means has reached a predetermined value; and conveyor means adapted for dismissing the retention of the stack by the stopper means and causing the stack to slide in the direction of conveyance along the first rail means from the stacking position to a position below the second rail means when the number counted by the supplying means has reached a predetermined value, the conveyor means being further adapted to slide the stacks on the first and second rail means therealong and to allow the stack on the second rail means to be placed on the stack on the first rail means at the end of the second rail means and to slide the superimposed stacks in the direction of conveyance along the first rail means.

According to a second aspect of the invention, there is provided an apparatus for inverting and stacking a plurality of folded box blanks, each having different thicknesses at its top and tail end portions, comprising: feeding means which includes supplying means for consecutively supplying the folded blanks, conveyor belt means for conveying in a predetermined direction of conveyance, the blanks supplied by the supplying means, roller means for lifting a predetermined portion of the conveyor belt means at a pre determined position, position adjusting means for adjusting the position of the roller means in a vertical direction and in the direction of conveyance, and counting means for counting the number of blanks conveyed by the conveyor belt means; and conveyor means which includes first rail means extending in a predetermined direction of conveyance and adapted for stacking and carrying the blanks supplied by the supplying means, stopper means for stopping and retaining the blanks supplied by the supplying means at a predetermined stacking position on the first rail means, second rail means extending in the direction of conveyance and disposed at a level above the level of the first rail means, the second rail means having an upstream end disposed downstream of an upstream end of the first rail means as viewed in the direction of conveyance, the second rail means terminating at a position above an intermediate portion of the first rail means, transferring means for inverting the stack of blanks on the first rail means onto the second rail means when the number counted by the counting means has reached a predetermined value, and conveyor means adapted for dismissing the retention of the stack by the stopper means and causing the stack to slide in the direction of conveyance supply along the first rail means from the stacking position to a position below the second rail means when the number counted by the counting means has reached a predetermined value, the conveyor means being further adapted to slide the stacks on the first and second rail means therealong and to allow the stack on the second rail means to be placed on the stack on the first rail means at the end of the second rail means and to slide the superimposed stacks in the direction of conveyance along the first rail means.

According to a third aspect of the present invention, there is provided an apparatus for inverting and stacking a plurality of folded box blanks, each having different thicknesses at its top and tail end portions, comprising: separating means which includes supplying means for consecutively supplying the folded blanks, conveyor belt means for conveying, in a predetermined direction of conveyance, the blanks supplied by the supplying means, roller means disposed above an intermediate portion of the conveyor belt means for providing a clearance which is just large enough for allowing passage of a single blank therethrough, the clearance being formed between the roller means and the conveyor belt means, the roller means being adapted for rotating in a direction opposite to the direction of conveyance, stopping plate means disposed upstream of the roller means for covering at least the upper half of the roller means, and counting means for counting the number of blanks conveyed through the clearance under the roller means, the frictional resistance produced between the surface of the roller means and the blank being smaller than the frictional resistance between the conveying surface of the conveyor belt means and the blank so that the successively fed blanks are separated into independent blanks; and conveyor means which includes first rail means extending in a predetermined direction of conveyance and adapted for stacking and carrying the blanks supplied by the supplying means, stopper means for stopping and retaining the blanks supplied by the supplying means at a predetermined stacking position on the first rail means, second rail means extending in the direction of conveyance and disposed at a level above the level of the first rail means, the second rail means having an upstream end disposed downstream of an upstream end of the first rail means as viewed in the direction of conveyance, the second rail means terminating at a position above an intermediate portion of the first rail means, transferring means for inverting the stack of blanks on the first rail means onto the second rail means when the number counted by the counting means has reached a predetermined value, and conveyor means adapted for dismissing the retention of the stack by the stopper means and causing the stack to slide in the direction of conveyance along the first rail means from the stacking position to a position below the second rail means when the number counted by the counting means has reached a predetermined value, the conveyor means being further adapted to slide the stacks on the first and second rail means therealong and to allow the stack on the second rail means to be placed on the stack on the first rail means at the end of the second rail means and to slide the superimposed stacks in the direction of conveyance along the first rail means.

According to a fourth aspect of the present invention, there is provided an apparatus for inverting and stacking a plurality of folded box blanks, each having different thicknesses at its top and tail end portions, comprising: feeding means which includes supplying means for consecutively supplying the folded blanks, conveyor belt means for conveying, in a predetermined direction of conveyance, the blanks supplied by the supplying means, roller means for lifting a predetermined portion of the conveyor belt means at a predetermined position, and position adjusting means for adjusting the position of the roller means in a vertical direction and in the direction of conveyance; separating means which includes conveyor belt means for conveying, in a predetermined direction of conveyance, the blanks fed by the feeding means, roller means disposed above an intermediate portion of the conveyor belt means for providing a clearance which is just large enough for allowing passage of a single blank therethrough, the clearance being formed between the roller means and the conveyor belt means, the roller means being adapted for rotation in a direction opposite to the direction of conveyance, stopping plate means disposed upstream of the roller means for covering at least the upper half of the roller means, and counting means for counting the number of blanks conveyed through the clearance under the roller means, the frictional resistance produced between the surface of the roller means and the blank being smaller than the frictional resistance between the conveying surface of the conveyor belt means and the blank so that the successively fed blanks are separated into independent blanks; and conveyor means which include first rail means extending in a predetermined direction of conveyance and adapted for stacking and carrying the blanks supplied by the supplying means, stopper means for stopping and retaining the blanks supplied by the supplying means at a predetermined stacking position on the first rail means, second rail means extending in the direction of conveyance and disposed at a level above the level of the first rail means, the second rail means having an upstream end disposed downstream of an upstream end of the first rail means as viewed in the direction of conveyance, the second rail means terminating at a position above an intermediate portion of the first rail means, transferring means for inverting the stack of blanks on the first rail means onto the second rail means when the number counted by the counting means has reached a predetermined value, and conveyor means adapted for dismissing the retention of the stack by the stopper means and causing the stack to slide in the direction of conveyance along the first rail means from the stacking position to a position below the second rail means when the number counted by the counting means has reached a predetermined value, the conveyor means being further adapted to slide the stacks on the first and second rail means therealong and to allow the stack on the second rail means to be placed on the stack on the first rail means at the terminal end of the second rail means and to slide the superimposed stacks in the direction of conveyance along the first rail means.

The above and other objects, features and advantages of the invention will become clear from the following description of the preferred embodiments taken in conjunction with the accompanying drawings.

DESCRIPTION OF THE PREFERRED EMBODIMENTS

A preferred embodiment of the present invention will now be described with reference to the accompanying drawings.

Figure 5:
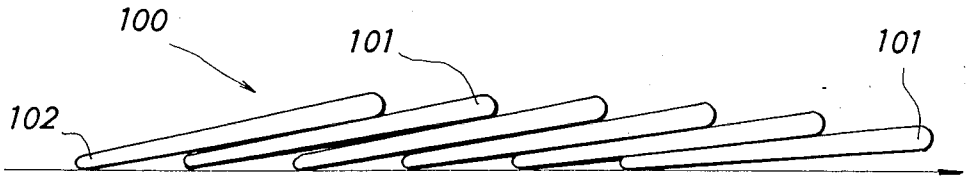
FIG. 5 is an illustration of a folded box blank ready for feeding into the devices shown in FIGS. 4*a* and 4*b.

A plurality of prefabricated box blanks 100 made from sheet material are glued at their bottoms as shown in FIG. 5 and fed in the direction of an arrow in the same Figure.

Figure 6:
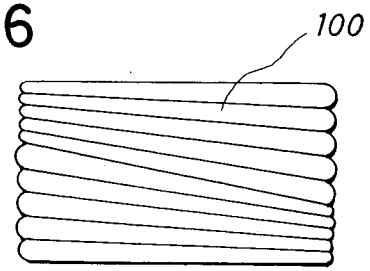
* and FIG. 6 is an illustration of a stack of blanks inverted and stacked by the inverting and stacking apparatus of the present invention.

As illustrated, each blank 100 has a thickness which is greater at its bottom portion 101 which is glued than at its top portion 102 which is not glued. The blanks 100 are fed such that the thicker glued bottom portions 102 are on the leading side, while the top portions are on the trailing side. When a plurality of such blanks 100 are stacked, half of the blanks 100 must be turned such that their orientation is reverse to that of the remaining half of the blanks 100. For instance, when it is desired to stack 10 such blanks 100, the top five blanks 100 are placed such that their glued bottom portions are on the left side of the stack while the bottom five blanks 100 have their glued bottom portions on the right side of the stack, as shown in FIG. 6. As a result, the stack as a whole has a uniform thickness or height.

The apparatus of the present invention is suitable for use in inverting and stacking consecutive blanks 100 such that alternating groups of the blanks 100, each of which includes five blanks, for example, are positioned in opposite orientations in a manner as shown, for example, in FIG. 6.

The inverting and stacking apparatus of the present invention is mainly comprised of three major devices: namely, a feeding device generally denoted by 10, a separating device generally denoted by 20 and an inverting device 30.

Briefly, the feeding device 10 is adapted for smoothly feeding a train or succession of consecutively supplied box blanks 100, while the separating device 20 is adapted for separating the train of blanks 100 into independent blanks 100 and conveying the consecutive blanks 100 while counting the same. The inverting device 30 is adapted for inverting every other group of blanks, each group including, for example, five blanks 100. Each device will now be described with reference to the drawings.

In the following description, it will be assumed that the blanks 100 are conveyed from the left to the right, as shown in FIG. 1.

Feeding Device 10

Figure 4A:
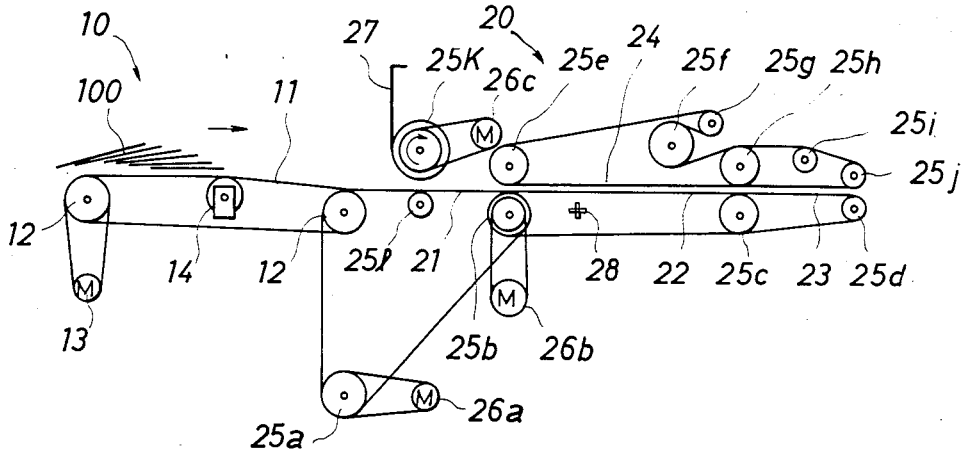
FIGS. 4*a* and 4*b* are a side elevational view and a top plan view, respectively, of a feeding device and a separation device incorporated in an embodiment of the inverting and stacking apparatus of the present invention.
Figure 4B:
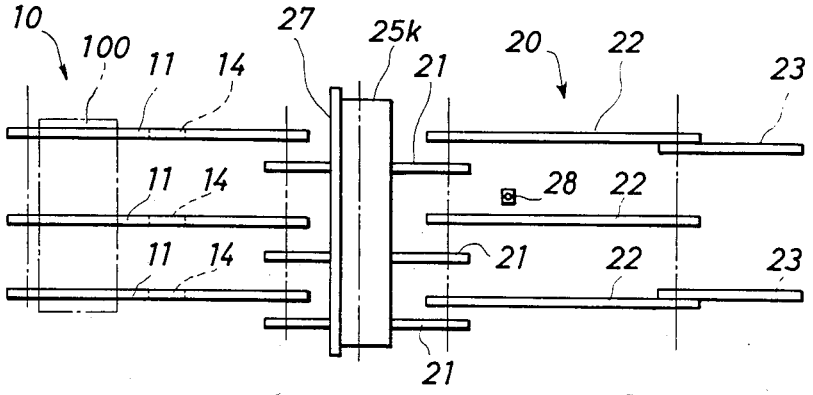

The feeding device is shown on the left hand side of FIGS. 4*a* and 4*b* which are a side elevational view and a top plan view of part of the apparatus of the invention, respectively. For the purpose of simplification in the drawings, the rollers and the associated driving mechanisms are omitted from FIG. 4*b* and only the axis of rotation of each roller is shown by a dot-and-dash line.

The feeding device includes a conveyor belt 11 wound around a pair of rollers 12, one of which is adapted to be driven by a motor 13. A train of glued and folded box blanks 100 is conveyed from left to right in a conveying direction, as shown by the arrow in FIG. 4*a*, with their glued bottom portions 101 positioned on the leading side and in a partially overlapped manner, as shown in FIG. 5.

Thus, the folded blanks 100 are consecutively conveyed in the direction of the arrow by the conveyor belt 11. One of such folded blanks 100 is shown in FIG. 4*b* by way of example.

This feeding device includes a roller 14 which is disposed at an intermediate portion of the conveyor belt 11. The roller 14 is located at a position where it can lift the conveyor belt 11. The position of the roller 14 is adjustable horizontally to the left and right and vertically up and down as viewed in FIG. 4*a*, by a suitable position adjusting means which may incorporate a rack-and-pinion type mechanism.

It is known from experience that when successive folded blanks 100 are conveyed by means of a conveyor belt, the leading end of each folded blank 100, i.e. the glued thick bottom portion 101, tends to float. Such a floating tendency undesirably decreases the frictional resistance between the conveyor belt and the blank, with the result that the desired smooth conveyance of the blanks is often interrupted. According to the invention, such a floating tendency is effectively suppressed by the roller 14. For instance, the floating of one or more folded blanks 100 is canceled by shifting the roller 14 to the region where the floating is taking place and lifting the conveyor belt 11 in this region.

The optimum position of the roller 14 varies depending on the type of folded blank 100, but the roller 14 can easily be set at the optimum position because its position is adjustable both horizontally back and forth and vertically up and down.

With this feeding device 10, therefore, it is possible to continuously feed the folded blanks 100 in an optimum condition without any floating of one or more of the blanks 100.

The thus fed folded blanks 100 are then fed to the separating device 20 stationed at the downstream end of the feeding device 10.

Separating Device 20

The separating device 20 is shown on the right side of FIGS. 4*a* and 4*b*. As previously explained, for the purpose of simplifying the drawings, the rollers and the associated driving mechanism therefor are omitted from FIG. 4*b* and only the axis of rotation of each roller is shown by a dot-and-dash line.

The separating device 20 includes conveyor belts 21 to 24 which are wound around rollers 25*a* to 25*j* and driven by means of motors 26*a* and 26*b*.

The conveyor belts 21 to 23 serve to convey the folded blanks 100 to the right as viewed in the drawings, while the conveyor belt 24, which is omitted from FIG. 4*b*, is adapted to support the conveyed folded blanks 100 from the upper side thereof.

This separating device 20 features a separating roller 25*k* which is positioned at an intermediate portion of the conveyor belt 21 and is adapted to rotate in a direction opposite to the direction of movement of the conveyor belt 21. More specifically, the separating roller 25*k* is driven in rotation by a motor 26*c* so as to provide a tangential force which acts in the direction opposite to the direction of conveyance of the folded blanks 100. A roller 251 which is positioned below the separating roller 25*k* supports the conveyor belt 21 from the lower side thereof. The separating roller 25*k* is located such that a clearance sized for passing only a single folded blank 100 is formed between itself and the conveyor surface of the conveyor belt 21.

A stopper plate 27 is disposed on the upstream side of the separating roller 25*k* as viewed in the direction of movement of the blanks 100, in such a manner as to cover at least the upper half of the separating roller 25*k*.

The materials from which the separating roller 25*k* and the conveyor belt 21 are made are selected such that the frictional resistance between the surface of the separating roller 25*k* and the folded blanks 100 is smaller than the frictional resistance between the surface of the conveyor belt 21 and the folded blanks 100.

Such a condition is met by using, for example, a rubber material and metallic material as the materials of the conveyor belt 21 and the separating roller 25*k*, respectively.

A photosensor 28 disposed at an intermediate portion of the conveyor belt 22 is adapted to count the folded blanks 100 which are conveyed by the conveyor 22.

Thus, the separating device 20 operates to separate the successive folded blanks 100 fed by the feeding device and to count the thus fed folded blanks 100. The operation of the separating device 20 is as follows.

Since the folded blanks 100 are successively fed in a partly overlapping manner as shown in FIG. 5, the blanks 100 are stacked on the upstream side of the stopper plate 27. The folded blanks 100 which have been brought into contact with the separating roller 25*k* are forced back towards the upstream side because the separating roller 25*k* is rotating in the direction opposite to the direction of conveyance of the folded blanks 100, so as to accumulate at the position where the stopper plate 27 is disposed.

In addition, the accumulated folded blanks 100 are prevented from being trapped by the upper half of the separating roller 25*k* because the upper half of this roller 25*k* is covered by the stopper plate 27.

Since the separating roller 25*k* which is made of, for example, a metal, and the conveyor belt 21 which is made of, for example, a rubber, exhibit different amounts of friction with respect to the folded blank 100, the lowermost folded blank 100, which directly contacts the conveyor belt 21, is pulled in the direction of conveyance by the frictional conveying force exerted by the conveyor belt 21.

As previously explained, a clearance of a size which is just large enough for allowing a single folded blank 100 to pass therethrough is formed between the separating roller 25*k* and the conveyor 21. Consequently, only the lowermost folded blank 100 from among the stack of blanks 100 is extracted and conveyed through the clearance between the separating roller 25*k* and the conveyor belt 21 in a one-by one fashion, and the individual folded blanks thus separated are then conveyed by the conveyor belts 22 and 23. The separated folded blanks 100 also are supported from the upper side thereof by the conveyor belt 24.

The running speeds of the conveyor belts are adjusted such that the speed of conveyance is progressively increased towards the downstream end of the path of conveyance. For instance, in the illustrated embodiment, the conveyor belt 11 runs at a speed of 10 m/sec, the conveyor belt 21 runs at 180 m/sec and the conveyor belts 22 and 23 run at 200 to 250 m/sec, respectively. In consequence, successively fed and separated folded blanks 100 are smoothly conveyed to the downstream side without any accumulation.

The folded blanks 100 which are being conveyed by the conveyor belt 22 are arranged with a suitable interval therebetween, so that they can easily be counted by the photosensor 28.

Thus, the separating device 20 is capable of separating successive folded blanks 100 into individual folded blanks 100 and counting the separated folded blanks 100.

Inverting Device 30

Figure 1A:
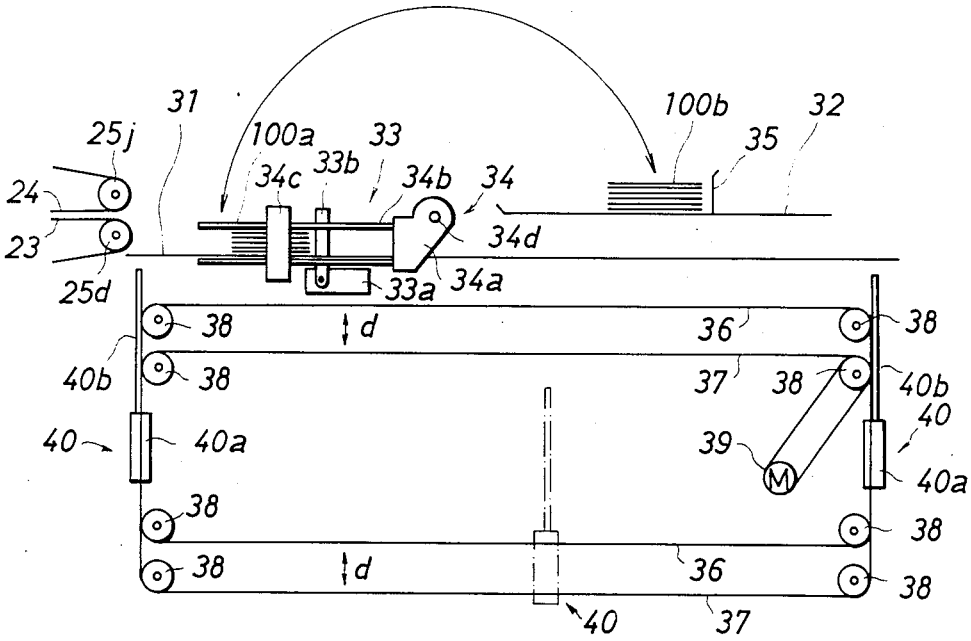
FIGS. 1*a* and 1*b* are a side elevational view and a top plan view, respectively, of an inverting device which constitutes a part of an embodiment of the apparatus of the invention for inverting and stacking folded box blanks made of a sheet material.
Figure 1B:
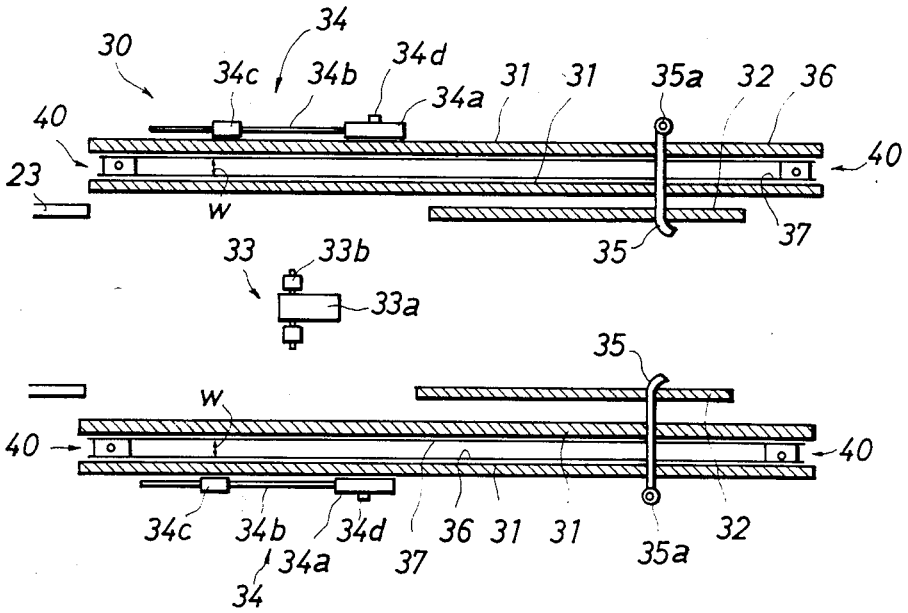

FIGS. 1*a* and 1*b* are a side elevational view and a top plan view of the inverting device 30.

This device is supplied with folded blanks 100 in a piece-by-piece fashion from the separating device 20.

The inverting device 30 is provided with a first rail device 31 which extends in the direction of conveyance so as to be able to receive the supplied folded blank 100 at its left end and to convey the same to the right, and a second rail device 32 which is disposed at a level vertically above the level of the first rail 31. In FIG. 1*b*, these rails are shown by hatching. The first rail device 31 includes two pairs of rails, one pair at each side of a vertical plane parallel to the direction of conveyance, while the second rail device includes only one pair of rails, each of which is on an opposite side of the vertical plane.

The upstream end of the second rail device is positioned substantially above the mid portion of the first rail device 31. The second rail device terminates at a position above an intermediate portion of the first rail device 31. In other words, the downstream end of the second rail means 32 is positioned upstream, i.e. on the left side as viewed in FIG. 1, of the downstream end of the first rail device 31.

A stopper 33, which is composed of a stopper body 33*a* and a stop bar 33*b*, is disposed at the mid portion between the two pairs of rails of the first rail device 31. The stop bar 33*b*, when it is positioned to project upright as illustrated in FIG. 1*a*, prevents the folded blanks 100 from moving towards the downstream end. The stop bar 33*b*, however, is movable, such as by pivoting about a horizontal axis, to a horizontal position so as to allow the folded blanks 100 to be conveyed towards the downstream end.

An inverting and transferring means comprises an inverting and transferring device 34 disposed on each side of the first rail device 31. Each inverting and transferring device 34 includes a support member 34*a*, an arm 4*b* and a clamper 34*c*. The support member 34*a* is rotatable about an axis provided by a shaft 34*d* so that the arm 34*b* is pivotable as indicated by the double arrow in FIG. 1*a*.

Figure 2:
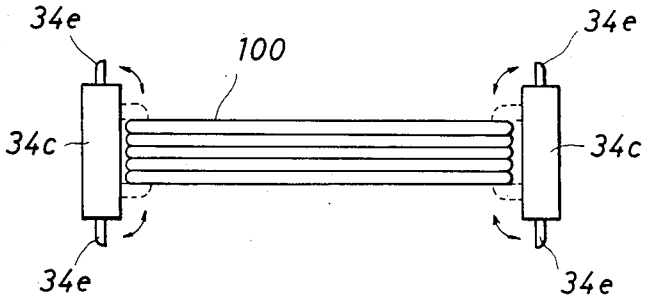
FIG. 2 is a front elevational view of a portion of an inverting device shown in FIGS. 1*a* and 1*b;*

FIG. 2 shows the pair of inverting and transferring devices 34. The clampers 34*c* are provided on the inner sides thereof with clamping claws 34*e* which are secured to upper and lower ends of these clampers 34*c* for pivotal movement as indicated by arrows. The clamping claws, when pivoted inwardly, can clamp a plurality of folded blanks 100. In operation, a stack of folded blanks 100 on the first rail device 31 is clamped by the clamping claws 34*e* on the clampers 34*c* and the support members 34*a* are caused to rotate as indicated by arrows. In consequence, the stack of the folded blanks 100 is swung and delivered to the second rail device 32 and is transferred thereto as the clamping claws are pivoted to release the stack. Thus, a stack of folded blanks 100b is set on the second rail device 32. It will be seen that the folded blanks are inverted and turned upside down during this transferring operation, so that the stack of folded blanks 100b on the second rail device 32 has an orientation opposite to that of the stack of folded blanks 100a on the first rail device 31.

A pivotable stopper 35 for temporarily stopping the stack of folded blanks 100b is provided on a predetermined portion of each of the two rails of the second rail device 2.

A pair of endless chains, i.e. an outer endless chain 36 and an inner endless chain 37, are disposed between each pair of rails of the first rail device 31. That is, one outer endless chain 36 is provided on each side of the apparatus, and one inner endless chain 37 is disposed on each side of the apparatus. In FIG. 1a, only the endless chains on one side of the apparatus are shown.

Each of the endless chains 36 and 37 is arranged to travel in a closed loop path having the shape of a substantially square closed loop supported at four corners by means of sprockets 38, and is adapted to run clockwise as viewed in FIG. 1a by means of a motor 39. The endless chain 36 has an upper run which is positioned at a level higher by a distance d than the upper run of the endless chain 37, and both endless chains 36 and 37 on each side of the apparatus are horizontally spaced apart by a distance w from each other.

A pair of conveyor members 40 are provided between the outer and the inner endless chains 36 and 37 at positions which are spaced from each other.

Figure 3A:
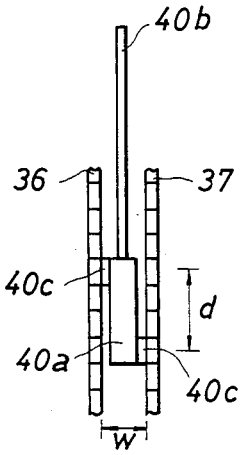
FIGS. 3*a* and 3*b* are front elevational views of a portion of the device shown in FIG. 1, showing particularly the manner in which a conveyor device is mounted.

As will be seen from FIG. 3, each conveyor member 40 is constituted by a conveyor body 40a, a conveyor bar 40b and a pair of connecting members 40c. Each of the connecting members 40c is adapted to rotatably connect the conveyor body 40a to a respective one of the endless chains 36, 37, and the conveyor bar 40b projects vertically upwardly from the conveyor body 40a.

It will be seen that the apparatus employs four conveyor members 40, two on each side thereof.

The pair of conveyor members 40 on each side of the apparatus are positioned at opposite sides of the loops of the endless belts 36, 37, i.e., at positions which are spaced from each other by a distance equal to one half the circumference of the loop, as shown by solid lines in FIG. 1a.

As the endless chains 36, 37 run clockwise, the left conveyor member 40 moves vertically upward and then moves horizontally from the left to the right. Meanwhile, the right conveyor member 40 moves vertically downward and then moves horizontally from the right to the left.

Figure 3B:
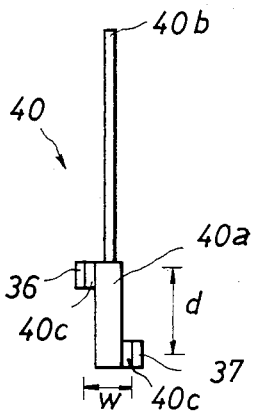

The broken line in FIG. 1 shows the conveyor body 40 moving vertically and FIG. 3b shows in front elevation the conveyor body 40 which is being moved horizontally.

As previously explained, the upper runs of the outer endless belt 36 and the inner endless belt 37 are spaced from each other by a distance d in the vertical direction, so that the conveyor body 40 can move in a stable condition even during horizontal movement thereof.

In consequence, each conveyor member 40 moves in the direction of conveyance, while keeping its conveyor bar 40b held in the upright position.

The operation of the inverting device 30 will be described as follows.

As previously explained, folded blanks 100 are successively supplied from the separating device 20 in a piece-by-piece fashion.

The folded blank 100 has a certain level of velocity when delivered from the conveyor belt 23 (shown at a left portion of FIG. 1a) to the first rail device 31. The folded blanks 100 thus successively supplied, however, are stopped by the stop bar 33b when the latter is set in the upright position, so that the folded blanks 100 successively reaching the stop bar 33b are stacked at a position immediately upstream of the stop bar 33b. This position will hereinafter be referred to as the "stacking position".

A description will now be made as to the case where 10 pieces of folded blanks 100 are stacked such that the top five blanks and the bottom five blanks have opposite orientations as shown in FIG. 6.

(a) Folded blanks 100 are successively conveyed into the inverting device until five blanks 100 are stacked at the stacking position. The stacking of five blanks can be detected by the separating device 20 which, as previously explained, has a function of counting the folded blanks which are being fed. FIG. 1a shows five folded blanks 100a stacked at the stacking position.

(b) Then, the clamping claws are activated to clamp the five folded blanks 100a stacked at the stacking position, and the arms 34b are swung in the direction of the arrow in FIG. 1a, so as to transfer the stack of folded blanks 100a onto the second rail device 32. The stack of folded blanks on the second rail 32 is denoted by number 100b.

The folded blanks 100b stacked on the second rail device 32 are prevented from moving forward by virtue of the stopper 35.

After completion of the transfer of the stack of folded blanks to the second rail device 32, the arms 34b are swung back to the starting position.

(c) Folded blanks are successively conveyed into the inverting device 30 and the apparatus waits for the arrival of five more folded blanks 100 at the stacking position.

(d) A new stack of folded blanks 100a thus formed is conveyed along the first rail device 31 without being inverted. To this end, the stop bar 33b is laid horizontally to allow the new stack of five folded blanks 100 to pass thereover. As the endless chains 36 and 37 are rotated, the conveyor bar 40b of one of the conveyor members 40 moves horizontally from the left position to the right position in FIG. 1a, while pushing the new stack of folded blanks 100a, so that the stack of folded blanks 100a slides along the first rail device 31 to the right as viewed in the drawings. It will be seen that when the new stack of folded blanks 100a reaches a position immediately below the first stack of folded blanks 100b carried by the second rail device 32, the conveyor bar 40b starts to simultaneously push both the first stack of folded blanks 100b and the new or second stack of folded blanks 100a, so that both stacks are made to slide along the second and first rail devices 32 and 31, respectively, to the right as viewed in the drawings.

Although the stoppers 35 are provided on the second rail device 32, the rightward movement of the first stack of folded blanks 100b is not hindered by the stoppers 35 because each of the stoppers is pivotable about a pillar 35a. The stoppers 35 are each urged into the stopping position by a spring which is provided in the pillar 35a and which allows the stopper 35 to be forcibly laid down when a force exceeding a predetermined level is applied thereto.

The downstream end of the second rail means 32 is positioned upstream of the downstream end of the first rail means 31 as explained earlier. Therefore, once the stack of folded blanks 100*b* has cleared the downstream end of the second rail device 32, it falls onto the second stack of folded blanks 100*a* carried by the first rail device 31, whereby a stack of 10 folded blanks, including five upper blanks and five lower blanks oriented in opposite directions is formed as shown in FIG. 6.

Stacking of 10 folded blanks is thus completed, by sequentially following steps (a) to (d), and successive stacks each consisting of 10 pieces of folded blanks stacked in the manner shown in FIG. 6 are formed as steps (a) to (d) are executed sequentially and repeatedly.

As will be understood from the foregoing description, according to the present invention, it is possible to smoothly, rapidly and automatically invert and stack a plurality of folded box blanks by means of an apparatus having upper and lower rail devices, an inverting device capable of inverting and transferring alternating stacks of a predetermined number of folded blanks from the lower rail device to the upper rail device, and a conveyor device for conveying stacks of the folded blanks on the upper and lower rail devices simultaneously.

Although the invention has been described through its preferred form, it is to be noted that the described embodiment is only illustrative and various changes and modifications may be imparted thereto without departing from the scope of the invention which is limited solely by the appended claims.

What is claimed is:

1. An apparatus for inverting and stacking a plurality of folded box blanks, each of which has a different thickness at its top and tail end portions, comprising:

supplying means for supplying said blanks along a direction of conveyance and for counting the number of said blanks;

first rail means extending along said direction of conveyance for receiving said blanks supplied by said supplying means;

stopper means for stopping and retaining said blanks supplied by said supplying means at a predetermined stacking position on said first rail means;

second rail means extending in said direction of conveyance and disposed vertically above said first rail means with an upstream end of said second rail means disposed downstream of said stacking position, a downstream end of said second rail means disposed at a position above an intermediate portion of said first rail means;

transferring means for inverting a first stack of said blanks at said stacking position on said first rail means onto said second rail means when a number of said blanks counted by said supplying means reaches a first predetermined value; and conveyor means disposed along said direction of conveyance for moving a second stack of said blanks at said stacking position on said first rail means downstream along said direction of conveyance past said stopper means to a position below said second rail means when a number of said blanks counted by said supplying means reaches a second predetermined value, said conveyor means further moving the first stack on said second rail means onto the second stack on said first rail means to form a combined stack of blanks on said first rail means, said conveyor means moving said combined stack downstream along said first rail means in said direction of conveyance.

2. An apparatus according to claim 1, wherein said transferring means includes a pair of arms, each of which is provided on opposite sides of a vertical plane extending along said direction of conveyance, said arms being disposed along said first rail means and being pivotable about an axis which is located between said stacking position and said second rail means, said axis extending perpendicularly to said direction of conveyance, said transferring means further including clamping claws provided on free ends of said arms for clamping said first stack of said blanks at opposite sides of said stack, whereby said first stack is inverted and transferred as a result of pivoting of said arms.

3. An apparatus according to claim 1, further comprising a stopper provided on said second rail means for temporarily retaining said first stack of said blanks which has been transferred to said second rail means.

4. An apparatus according to claim 2, further comprising a stopper provided on said second rail means for temporarily retaining said first stack of said blanks which has been transferred to said second rail means.

5. An apparatus according to claim 1, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

6. An apparatus according to claim 2, wherein said conveyor means includes a pair of rod-like members, each of which is projected upwardly from a lower side of said first rail means and disposed on one side of said vertical plane, said conveyor means further comprising driving means for driving said pair of rod-like members in the direction of conveyance to engage the first, second and combined stacks.

7. An apparatus according to claim 3, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

8. An apparatus according to claim 5, wherein said driving means comprises a pair of parallel chain belts on each side of said vertical plan, each of said rod-like members being connected to a respective pair of said chain belts so that said rod-like members are moved in the direction of conveyance during movement of said chain belts.

9. An apparatus according to claim 6, wherein said driving means comprises a pair of parallel chain belts on each side of said vertical plane, each of said rod-like members being connected to a respective pair of said chain belts so that said rod-like members are moved in the direction of conveyance during movement of said chain belts.

10. An apparatus according to claim 7, wherein said driving means comprises a pair of parallel chain belts on each side of said vertical plane, each of said rod-like members being connected to a respective pair of said chain belts so that said rod-like members are moved in the direction of conveyance during movement of said chain belts.

11. An apparatus for inverting and stacking a plurality of folded box blanks, each of which has a different thickness at its top and tail end portions, comprising:

(a) feeding means which is adapted to receive blanks from a supplying means for consecutively supplying said folded blanks, said feeding means including conveyor belt means for conveying said blanks supplied by said supplying means in a predetermined direction of conveyance, roller means for vertically lifting a predetermined portion of said conveyor belt means at a predetermined position along said direction of conveyance, position adjusting means for vertically and horizontally adjusting the position of said roller means, and counting means for counting a number of said blanks conveyed by said conveyor belt means; and (b) conveying means which includes first rail means extending along said direction of conveyance for receiving said blanks supplied by said feeding means;

stopper means for stopping and retaining said blanks supplied by said feeding means at a predetermined stacking position on said first rail means;

second rail means extending in said direction of conveyance and disposed vertically above said first rail means with an upstream end of said second rail means disposed downstream of said stacking position, a downstream end of said second rail means disposed at a position above an intermediate portion of said first rail means;

transferring means for inverting a first stack of said blanks at said stacking position on said first rail means onto said second rail means when a number of said blanks counted by said feeding means reaches a first predetermined value; and conveyor means disposed along said direction of conveyance for moving a second stack of said blanks at said stacking position on said first rail means downstream along said direction of conveyance past said stopper means to a position below said second rail means when a number of said blanks counted by said feeding means reaches a second predetermined value, said conveyor means further moving the first stack on said second rail means onto the second stack on said first rail means to form a combined stack of blanks on said first rail means, said conveyor means moving said combined stack downstream along said first rail means in said direction of conveyance.

12. An apparatus according to claim 11, wherein said transferring means includes a pair of arms, each of which is provided on opposite sides of a vertical plane extending along said direction of conveyance, said arms being disposed along said first rail means and being pivotable about an axis which is located between said stacking position and said second rail means, said axis extending perpendicularly to said direction of conveyance, said transferring means further including clamping claws provided on free ends of said arms for clamping said first stack of said blanks at opposite sides of said stack, whereby said first stack is inverted and transferred as a result of pivoting of said arms.

13. An apparatus according to claim 11, further comprising a stopper provided on said second rail means for temporarily retaining said first stack of said blanks which has been transferred to said second rail means.

14. An apparatus according to claim 12, further comprising a stopper provided on said second rail means for temporarily retaining said first stack of said blanks which has been transferred to said second rail means.

15. An apparatus according to claim 11, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

16. An apparatus according to claim 12, wherein said conveyor means includes a pair of rod-like members, each of which is projected upwardly from a lower side of said first rail means and disposed on one side of said vertical plane, said conveyor means further comprising driving means for driving said pair of rod-like members in the direction of conveyance to engage the first, second and combined stacks.

17. An apparatus according to claim 13, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

18. An apparatus according to claim 15, wherein said driving means comprises a pair of parallel chain belts on each side of said vertical plane, each of said rod-like members being connected to a respective pair of said chain belts so that said rod-like members are moved in the direction of conveyance during movement of said chain belts.

19. An apparatus according to claim 16, wherein said driving means comprises a pair of parallel chain belts on each side of said vertical plane, each of said rod-like members being connected to a respective pair of said chain belts so that said rod-like members are moved in the direction of conveyance during movement of said chain belts.

20. An apparatus according to claim 17, wherein said driving means comprises a pair of parallel chain belts on each side of said vertical plane, each of said rod-like members being connected to a respective pair of said chain belts so that said rod-like members are moved in the direction of conveyance during movement of said chain belts.

21. An apparatus for inverting and stacking a plurality of folded box blanks, each of which has a different thickness at its top and tail end portions, comprising:

(a) separating means which is adapted to receive blanks from a supplying means for consecutively supplying said folded blanks, said separating means including conveyor belt means for conveying said blanks supplied by said supplying means in a predetermined direction of conveyance;

roller means disposed above an intermediate portion of said conveyor belt means for forming a clearance which is just large enough to allow passage of a single one of said blanks along said conveyor belt means, said clearance being formed between said roller means and the conveyor belt means, said roller means being constructed and arranged for rotating in a direction opposite to said direction of conveyance of said conveyor belt means, stopping plate means disposed upstream of said roller means for covering at least an upper half of said roller means, and counting means for counting a number of said blanks conveyed through said clearance under said roller means, a frictional resistance produced between a surface of said roller means and said blank being less than a frictional resistance between a conveying surface of said conveyor belt means and said blank so that the successively fed blanks are separated from each other; and (b) conveying means which includes first rail means extending along said direction of conveyance for receiving said blanks supplied by said separating means;

stopper means for stopping and retaining said blanks supplied by said separating means at a predetermined stacking position on said first rail means;

second rail means extending in said direction of conveyance and disposed vertically above said first rail means with an upstream end of said second rail means disposed downstream of said stacking position, a downstream end of said second rail means disposed at a position above an intermediate portion of said first rail means;

transferring means for inverting a first stack of said blanks at said stacking position on said first rail means onto said second rail means when a number of said blanks counted by said separating means reaches a first predetermined value; and conveyor means disposed along said direction of conveyance for moving a second stack of said blanks at said stacking position on said first rail means downstream along said direction of conveyance past said stopper means to a position below said second rail means when a number of said blanks counted by said separating means reaches a second predetermined value, said conveyor means further moving the first stack on said second rail means onto the second stack on said first rail means to form a combined stack of blanks on said first rail means, said conveyor means moving said combined stack downstream along said first rail means in said direction of conveyance.

22. An apparatus according to claim 21, wherein said transferring means includes a pair of arms, each of which is provided on opposite sides of a vertical plane extending along said direction of conveyance, said arms being disposed along said first rail means and being pivotable about an axis which is located between said stacking position and said second rail means, said axis extending perpendicularly to said direction of conveyance, said transferring means further including clamping claws provided on free ends of said arms for clamping said first stack of said blanks at opposite sides of said stack, whereby said first stack is inverted and transferred as a result of pivoting of said arms.

23. An apparatus according to claim 21, further comprising a stopper provided on said second rail means for temporarily retaining said first stack of said blanks which has been transferred to said second rail means.

24. An apparatus according to claim 22, further comprising a stopper provided on said second rail means for temporarily retaining said first stack of said blanks which has been transferred to said second rail means.

25. An apparatus according to claim 21, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

26. An apparatus according to claim 22, wherein said conveyor means includes a pair of rod-like members, each of which is projected upwardly from a lower side of said first rail means and disposed on one side of said vertical plane, said conveyor means further comprising driving means for driving said pair of rod-like members in the direction of conveyance to engage the first, second and combined stacks.

27. An apparatus according to claim 23, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

28. An apparatus for inverting and stacking a plurality of folded box blanks, each of which has a different thickness at its top and tail end portions, comprising:

(a) feeding means which is adapted to receive blanks from a supplying means for consecutively supplying said folded blanks, said feeding means including conveyor belt means for conveying said blanks supplied by said supplying means in a predetermined direction of conveyance, roller means for vertically lifting a predetermined portion of said conveyor belt means at a predetermined position along said direction of conveyance, position adjusting means for vertically and horizontally adjusting the position of said roller means; and (b) separating means which includes separating roller means disposed above an intermediate portion of said conveyor belt means for forming a clearance which is just large enough to allow passage of a single one of said blanks along said conveyor belt means, said clearance being formed between said separating roller means and the conveyor belt means, said separating roller means being constructed and arranged for rotating in a direction opposite to said direction of conveyance of said conveyor belt means, stopping plate means disposed upstream of said separating roller means for covering at least an upper half of said separating roller means, and counting means for counting a number of said blanks conveyed through said clearance under said separating roller means, a frictional resistance produced between a surface of said separating roller means and said blank being less than a frictional resistance between a conveying surface of said conveyor belt means and said blank so that the successively fed blanks are separated from each other; and (c) conveying means which includes first rail means extending along said direction of conveyance for receiving said blanks supplied by said feeding means;

stopper means for stopping and retaining said blanks supplied by said feeding means at a predetermined stacking position on said first rail means;

second rail means extending in said direction of conveyance and disposed vertically above said first rail means with an upstream end of said second rail means disposed downstream of said stacking position, a downstream end of said second rail means disposed at a position above an intermediate portion of said first rail means;

transferring means for inverting a first stack of said blanks at said stacking position on said first rail means onto said second rail means when a number of said blanks counted by said feeding means reaches a first predetermined value; and conveyor means disposed along said direction of conveyance for moving a second stack of said blanks at said stacking position on said first rail means downstream along said direction of conveyance past said stopper means to a position below said second rail means when a number of said blanks counted by said feeding means reaches a second predetermined value, said conveyor means further moving the first stack on said second rail means onto the second stack on said first rail means to form a combined stack of blanks on said first rail means, said conveyor means moving said combined stack downstream along said first rail means in said direction of conveyance.

29. An apparatus according to claim 28, wherein said transferring means includes a pair of arms, each of which is provided on opposite sides of a vertical plane extending along said direction of conveyance, said arms being disposed along said first rail means and being pivotable about an axis which is located between said stacking position and said second rail means, said axis extending perpendicularly to said direction of conveyance, said transferring means further including clamping claws provided on free ends of said arms for clamping said first stack of said blanks at opposite sides of said stack, whereby said first stack is inverted and transferred as a result of pivoting of said arms.

30. An apparatus according to claim 28, further comprising a stopper provided on said second rail means for temporarily retaining said first stack of said blanks which has been transferred to said second rail means.

31. An apparatus according to claim 29, further comprising a stopper provided on said second rail means for temporarily retaining said first stack of said blanks which has been transferred to said second rail means.

32. An apparatus according to claim 28, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

33. An apparatus according to claim 29, wherein said conveyor means includes a pair of rod-like members, each of which is projected upwardly from a lower side of said first rail means and disposed on one side of said vertical plane, said conveyor means further comprising driving means for driving said pair of rod-like members in the direction of conveyance to engage the first, second and combined stacks.

34. An apparatus according to claim 30, wherein said conveyor means includes a pair of rod-like members, each of which is projected upwardly from a lower side of said first rail means and disposed on one side of a vertical plane extending along said direction of conveyance, said conveyor means further comprising driving means for driving said pair of rod-like members in the direction of conveyance to engage the first, second and combined stacks.

35. An apparatus according to claim 32, wherein said driving means comprises a pair of parallel chain belts on each side of said vertical plane, each of said rod-like members being connected to a respective pair of said chain belts so that said rod-like members are moved in the direction of conveyance during movement of said chain belts.

* * * * *